US007951757B2

(12) United States Patent
Carpenter et al.

(10) Patent No.: US 7,951,757 B2
(45) Date of Patent: May 31, 2011

(54) LOW VISCOSITY FUNCTIONAL FLUIDS

(75) Inventors: Gregory A. Carpenter, Cross Lanes, WV (US); Pearl L. Crossen, Redcar (GB)

(73) Assignee: Dow Global Technologies LLC, Midland, MI (US)

( * ) Notice: Subject to any disclaimer, the term of this patent is extended or adjusted under 35 U.S.C. 154(b) by 791 days.

(21) Appl. No.: 11/427,540

(22) Filed: Jun. 29, 2006

(65) Prior Publication Data

US 2007/0027039 A1 Feb. 1, 2007

Related U.S. Application Data

(60) Provisional application No. 60/696,130, filed on Jul. 1, 2005.

(51) Int. Cl.
*C10M 129/16* (2006.01)
*C10M 129/88* (2006.01)
*C10M 129/95* (2006.01)

(52) U.S. Cl. ..... 508/199; 508/579

(58) Field of Classification Search ..... 508/199, 508/532, 583, 579
See application file for complete search history.

(56) References Cited

U.S. PATENT DOCUMENTS

| | | | | |
|---|---|---|---|---|
| 3,914,182 | A * | 10/1975 | Ker et al. | 252/75 |
| 3,972,822 | A * | 8/1976 | Sato et al. | 252/78.1 |
| 4,219,434 | A * | 8/1980 | Ellis | 252/78.1 |
| 4,298,488 | A * | 11/1981 | Tanizaki et al. | 252/78.1 |
| 4,371,448 | A | 2/1983 | Knoblauch et al. | |
| 5,310,493 | A * | 5/1994 | Olson et al. | 252/74 |
| 6,436,883 | B1 | 8/2002 | Nieh | |
| 6,558,569 | B1 | 5/2003 | Shannon et al. | |
| 6,974,992 | B2 | 12/2005 | Takeuchi | |

FOREIGN PATENT DOCUMENTS

| | | |
|---|---|---|
| DE | 100 57 440 A1 | 8/2001 |
| EP | 0617116 | 9/1994 |
| EP | 0750033 | 12/1996 |
| EP | 0604111 | 5/1997 |
| GB | 1183016 | 3/1970 |
| JP | 10-36869 | 2/1998 |
| WO | WO98/09084 | 3/1998 |
| WO | WO0238711 | 5/2002 |

OTHER PUBLICATIONS

International Search Report, Dec. 28, 2006.
International Search Report, Application No. PCT/US2008/079498, mailed Mar. 12, 2009.
International Preliminary Report on Patentability, Application No. PCT/US2008/079487, mailed Oct. 23, 2009.

* cited by examiner

*Primary Examiner* — Glenn A Caldarola
*Assistant Examiner* — Taiwo Oladapo
(74) *Attorney, Agent, or Firm* — Dobrusin & Thennisch PC

(57) ABSTRACT

The fluid compositions of the present invention include an alkoxy glycol component, where the composition includes no more than about 10 wt % of a borate ester based on the weight of the composition. The physical properties of the compositions of include a high dry equilibrium reflux boiling point (ERBP), a high wet equilibrium reflux boiling point (WERBP), and a low temperature viscosity. These compositions are particularly useful because their physical properties (e.g., WERBP, ERBP, and low temperature viscosity) meet or exceed the provisions for DOT 3 brake fluids under the Federal Motor Vehicle Standard No. 116.

12 Claims, No Drawings

LOW VISCOSITY FUNCTIONAL FLUIDS

CLAIM OF PRIORITY

This application claims the benefit of U.S. provisional application 60/696,130, filed on Jul. 1, 2005, which is hereby incorporated by reference.

FIELD OF THE INVENTION

This invention relates to low viscosity functional fluids that are useful in a variety of applications, The functional fluids of the present invention are particularly useful as hydraulic fluids such as brake fluids for anti-lock brake systems or stability control systems for automotive vehicles that benefit from lower viscosity fluids for sudden braking and satisfactory operation at low temperatures.

BACKGROUND OF THE INVENTION

Newly developed equipment such as electronic or automated anti-lock braking systems and stability control systems have created a need for high performance brake fluids having appropriate physical and performance properties. In particular, there is a strong demand for high performance brake fluids having good low temperature viscosities while meeting or exceeding the desired minimum dry equilibrium reflux boiling point (ERBP) and wet equilibrium reflux boiling point (WERBP) temperatures. One set of standards for brake fluids are known as Federal Motor Vehicle Standard 116, which includes the standard DOT3 and DOT4, with the standard set forth below:

TABLE 1

DOT 3 and DOT 4 Brake Fluid Standard

| | Min. ERBP | Min. WERBP | Max. Viscosity at −40° C. |
|---|---|---|---|
| DOT 3 | 205° C. | 140° C. | 1500 cSt |
| DOT 4 | 230° C. | 155° C. | 1800 cSt |

Other standards include SAE J1703 and ISO 4925.

While functional fluids meeting these standards may be known, there is a need for fluids using readily available components that may be used in cost-effective alternatives, including those that minimize or eliminate the need for a borate ester.

SUMMARY OF THE INVENTION

The inventors have recognized solutions to one or more of the above problems by providing a functional fluid composition possessing a dry equilibrium reflux boiling point, wet equilibrium reflux boiling point, and cold temperature viscosity that may be used as DOT 3 brake fluids. Further, the minimization of the use of a borate ester is desirable, Moreover, the low temperature viscosity of the compositions is sufficiently low so that when used as a brake fluid, the brake system does not require a pneumatic or hydraulic booster to adequately brake in emergency situations.

DETAILED DESCRIPTION OF THE INVENTION

The functional fluid compositions of the present invention have a number of applications; however, they are especially useful as hydraulic fluids such as brake fluids. The fluid compositions of the present invention include an alkoxy glycol mixture that includes no more than about 10 wt % of a borate ester based on the weight of the composition. The physical properties of the compositions include a high dry equilibrium reflux boiling point (ERBP), a high wet equilibrium reflux boiling point (WERBP), and a low temperature viscosity.

Functional fluid compositions of the present invention are particularly useful because their physical properties (e.g., WERBP, ERBP, and low temperature viscosity) meet the provisions for DOT 3 brake fluids under the Federal Motor Vehicle Standard No. 116.

The physical properties of the present compositions as well as the presence of borate ester, or lack thereof, allow it to serve especially well as a brake fluid. Moreover, compositions lacking borate ester meet the requirements necessary for DOT 3 brake fluids.

Functional fluids of the present invention comprise:

(a) about 50 wt % to about 100 wt %, based on the total weight of the composition of an alkoxy glycol component;

(b) about 0 wt % to about 10 wt %, based on the weight of the total composition, of an alkoxy glycol borate ester component; and (c) about 0.30 wt % to about 10 wt %, based on the weight of the total composition, of an additives package.

Preferably the alkoxy glycol component has the formula: $RO(CH_2CH_2O)_nH$, where R is an alkyl group containing 1 to 8 carbon atoms or mixtures thereof, n is 1 or more, preferably n is 2 or more; alkoxy glycol in which n=2 is present in an amount of from about 0.25 wt % to about 10.00 wt %, based on the weight of the alkoxy glycol component, alkoxy glycol in which n=3 is present in an amount of from about 25.0 wt % to about 99.5 wt %, and alkoxy glycol in which n=4 or more is present in an amount from about 0 wt % to about 15 wt %;

Preferred alkoxy glycol components comprise a chemical formula wherein n=2 or more and are present in the fluid composition in an amount between about 50 wt % and 100 wt % of the composition; preferably, between about 60 wt % and about 90 wt % of the composition; and most preferably, between about 75 wt % and about 85 wt % of the composition.

Preferable alkoxy glycol components comprise alkoxy glycols where n=2, alkoxy glycols where n=3, alkoxy glycols where n=4 or more, or mixtures thereof. More preferable alkoxy glycol components comprise a mixture of alkoxy glycols having n=2, n=3 and n=4 or more.

In one embodiment, the alkoxy glycol component comprises an alkoxy glycol with an n=2 in an amount from about 0.50 wt % to about 20 wt % of the or component. Preferably, the alkoxy glycol with an n=2 is present in an amount from about 1.50 wt % to about 5.00 wt % of the or component. More preferably. the alkoxy glycol with an n=2 is present in an amount between about 2.00 wt % and about 4.00 wt % of the or component; and most preferably, it is present in an amount between about 2.50 wt % and 3.50 wt % of the or component.

In another embodiment, the or component comprises an alkoxy glycol with an n=3. Preferably, the n=3 alkoxy glycol is present in an amount between about 50 wt % and about 99.5 wt % of the or component; more preferably, it is present in an amount between about 55.0 wt % and about 85.0 wt %; and most preferably, the n=3 alkoxy glycol is present in an amount between about 62.0 wt % and about 64.0 wt % of the or component.

In yet another embodiment, the or component comprises an n=4 alkoxy glycol in amount between about 0 wt % and about 30 wt % of the or component. Preferably, it is present in an amount between about 1 wt % and about 25 wt % or the or component; more preferably, between about 10 wt % and about 20 wt % of the or component; and most preferably, between about 14 wt % and about 16 wt % of the or component.

Suitable R groups of the alkoxy glycol component are alkyl groups containing from 1 to 8 carbon atoms. Preferable alkoxy glycol components include an R group comprising a methyl, an ethyl, a propyl, a butyl, or combinations thereof. More preferable alkoxy glycols include an R group comprising a methyl, an ethyl, a butyl, or combinations thereof. Still more preferable alkoxy glycols include an R group comprising a methyl, a butyl, or a combination thereof. Most preferred alkoxy glycol components include a mixture of methyl alkoxy glycols (i.e., methoxy glycols) and butyl alkoxy glycols (i.e., butoxy glycols).

Without limitation, examples of useful alkoxy glycols include methoxy triglycol, methoxy diglycol, methoxy polyglycol, ethoxy triglycol, ethoxy diglycol, ethoxy tetraglycol, propoxy triglycol, butoxy triglycol (e.g., triethylene glycol monobutyl ether), butoxy diglycol (e.g., diethylene glycol monobutyl ether), butoxy teteraglycol, pentoxy diglycol, pentoxy triglycol, 2-ethylhexyl diglycol and mixtures thereof.

Preferable alkoxy glycol components include methoxy triglycol, methoxy diglycol, methoxy polyglycol, ethoxy triglycol, ethoxy diglycol, ethoxy tetraglycol, butoxy triglycol, butoxy diglycol, butoxy teteraglycoi, or mixtures thereot More preferable alkoxy glycol components comprise methoxy triglycol, methoxy diglycol, methoxy polyglycol, butoxy triglycol, butoxy diglycol, butoxy polyglycol, or mixtures thereof. Most preferable alkoxy glycol components comprise a mixture of methoxy polyglycol, butoxy diglycol, butoxy triglycol or butoxy polyglycol.

In one preferred embodiment, the alkoxy glycol component includes from about 5 wt % to about 20 wt % of a methoxy polyglycol, from about 1 wt % to about 6 wt % of a butoxy diglycol, and from about 50 wt % to about 90 wt % of a butoxy triglycol. In a more preferred embodiment, the glycol component includes from about 10 wt % to about 18 wt % of a methoxy polyglycol, from about 2 wt % to about 5 wt % of a butoxy diglycol, and from about 55 wt % to about 80 wt % of a butoxy triglycol. The most preferred embodiment includes a methoxy poly glycol in an amount from about 16 wt % to about 17 wt % of the component, a butoxy diglycol (e.g., butyl CARBITOL™ available from the Dow Chemical Company), in an amount from about 3 wt % to about 4 wt % of the component, and a butoxy triglycol in an amount between about 78 wt % and 80 wt % of the component.

Without limitation, methods of preparing useful alkoxy glycols include an alkoxilation reaction that reacts an alkylene oxide with an alcohol to produce an alkyl glycol.

In one aspect, use of high purity alkoxy glycol components is preferable. For example, by using high purity alkoxy glycol, a suitable low temperature viscosity is achievable. In particular, high purity butoxy triglycol and butoxy diglycol may individually or in combination be used to help maintain the desired low temperature viscosity. In one aspect, high purity alkoxy glycol is at least about 90% pure; at least about 97% pure, or at least about 98% pure. In one preferred embodiment, high purity butoxy triglycol and high purity butoxy diglycol is utilized in the fluid composition.

When utilized, preferably the alkoxy glycol borate ester component has the formula: $[RO(CH_2CH_2O)_n]_3$—B, where R is an alkyl group containing 1 to 8 carbon atoms or mixtures thereof and n is 2 to 4.

Examples of optional alkoxy glycol borate ester components include methoxy triethylene glycol borate ester, ethyl triethylene glycol borate ester, butyl triethylene glycot borate ester and mixtures thereof disclosed in U.S. Pat. No. 6,558,569, hereby incorporated by reference. If a borate ester component is present in the composition, it is preferably present in an amount less than about 10 wt % of the composition. More preferably, the borate ester component is present in the composition in an amount less than about 4 wt %. In one embodiment, the fluid compositions of the present invention are substantially free of any borate ester component.

Fluid compositions may also include an additives package that comprises from 0.3 to about 10 wt %, based on the total weight of the composition. Preferably, the additives package is present in an amount between about 1 wt % and about 5 wt % of the composition; more preferably, between about 2 wt % and about 4 wt % of the composition; and most preferably between about 3.0 wt % and about 3.5 wt % of the composition.

Suitable additives packages may include, without limitation, corrosion inhibitors, stabilizers such as pH stabilizers, anti-foaming agents, antioxidants, and combinations thereof.

Many known corrosion inhibitors such as the alkanol amines or alkyl amines and other organic amines increase low temperature viscosity of functional fluids containing borate esters, which in turn leads to the use of more complex and expensive additives such as those disclosed in EP0750033 and EP0617116. By using small amounts of borate esters, the fluid compositions may use known corrosion inhibitors and still achieve the desired low temperature viscosity. In addition, increased amounts of corrosion inhibitors and additives may be used to achieve improved stability or corrosion resistance without sacrificing low viscosity.

Examples of classes of corrosion inhibitors that may be used in the functional fluid compositions of the present invention include fatty acids such as lauric, palmitic, stearic or oleic acids, esters of phosphorus or phosphoric acid with aliphatic alcohols phosphites such as ethyl phosphate, dimethyl phosphate, isopropyl phosphate, butyl phosphite, triphenyl phosphite and diisopropyl phosphite, heterocyclic nitrogen containing compounds such as benzotriazole or its derivatives and mixtures of such compounds with 1,2,4 triazole and its derivatives (see U.S. Pat. No. 6,974,992, hereby incorporated by reference). Other amine compounds useful as corrosion inhibitors include alkyl amines such as di-n-butylamine and di-n-amylamine, cyclohexylamine and salts thereof. Amine compounds which are particularly useful as corrosion inhibitors in the functional fluid compositions of the present invention include the alkanol amines, preferably those containing one to three alkanol groups with each alkanol group containing from one to six carbon atoms. Examples of useful alkanol amines include mono-, di- and trimethanolamine, mono-, di- and triethanolamine, mono-, di- and tripropanolamine and mono-, di- and triisopropanolamine. In one aspect diisopropanolamine is utilized, which is readily available and inexpensive.

The additives packages may also advantageously contain, in addition to one or more corrosion inhibitors, other additive compounds such as antifoaming agents, pH stabilizers, antioxidants and the like, all well known to the skilled formulator for enhancing the performance of the functional fluid composition. Such other additives in combination with the corrosion inhibitors are normally present in an amount of from about 0.3 to about 10.0 wt %, based on the total weight of the functional fluid composition.

One preferred additives package includes a corrosion inhibitor (e.g., diisopropanolamine CAS #110-97-4), a pH stabilizer (e.g., sodium nitrate CAS #23-721-3), an anti-foaming agent (e.g., SAG Antifoam CAS #63148-62-9 available from the Union Carbide Corporation), and an antioxidant (e.g., 2,4-dimethyl-6-t-butyl phenol CAS #1879-09-0).

It is contemplated that other materials may be formulated into the functional fluids of the present invention so long as care is taken not to lower the ERBP or WERBP temperatures below acceptable levels or to increase the low temperature viscosity above an acceptable level. For example, the functional fluids of the present invention may include from about 0 wt % to about 30 wt %, based on the total weight of the composition, of a diluent or a lubricant such as, for example, polyethylene oxides, polypropylene oxides, polyglycols (e.g. mixtures of monoethylene glycol, diethylene gycol, triethylene glycol tetraethylene glycol, and higher mol adducts of ethylene glycol), poly(alkylene oxides) dialkoxyglycols, borate co-esters, or combinations thereof. One preferred embodiment includes a polyglycol in an amount from about 5 wt % to about 25 wt % more preferably, in an amount between about 15 wt % and about 22 wt % and most preferably, in an amount between about 18.5 wt % and about 19.5 wt %.

It is also contemplated that the teachings of the present invention could be applied to other fluids formulated to achieve lower viscosities such as those disclosed in U.S. Pat. No. 4,371,448, EP0750033 and EP0617116 (hereby incorporated by reference) to further lower viscosity while maintaining acceptable minimum ERBP and WERBP temperatures.

Fluid compositions of the present invention have an ERBP of at least about 205° C., preferably at least about 225° C., more preferably at least about 250° C., and most preferably at least about 270° C. or more (e.g. 300° C.). Fluid compositions of the present invention have a WERBP of at least about 140° C., preferably at least about 145° C., and more preferably at least about 150° C. or more (e.g. 160° C.), The low temperature viscosity at −40° C. of the fluid composition is preferably less than 1500 centistokes (cSt), preferably less than about 1250 cSt, more preferably less than about 1050 cSt, and most preferably less than about 880 cSt. In one embodiment, the cold temperature viscosity at −30° C. of the fluid composition is preferably less than about 750 cSt, more preferably less than about 500 cSt, and most preferably less than about 350 cSt.

EXAMPLE FORMULATION

The following example is not intended to be limiting and illustrates a certain preferred embodiment of the present invention.

| Component | Chemical Name | Amount in the total fluid composition |
|---|---|---|
| Alkoxy Glycol Component | Methoxypoly glycol | 13.3 wt % |
| Alkoxy Glycol Component | Butoxy triglycol | 63.7 wt % |
| Alkoxy Glycol Component | Butoxy diglycol | 3 wt % |
| Lubricant | Polyglycol | 19.07 wt % |
| Additives package | | 3.03 wt % |
| Corrosion Inhibitor | Diisopropanol amine | |
| pH stabilizer | Sodium Nitrate | |
| Antifoam agent | SAG Antifoam | |
| Antioxidant | 2,4-dimethyl-6-t-butyl phenol | |

This formulation for a functional fluid was analyzed to measure its physical properties relating to DOT 3 brake fluid requirements. The physical properties were measured to be (using the test procedures set forth the Federal Motor Vehicle Standard 116 found at §571.116 et seq.):

| | |
|---|---|
| ERBP | 270° C. |
| WERBP | 145° C. |
| Viscosity at a temperature of −40° C. | 859 cSt |

Functional fluids of the present invention are well suited for use as a hydraulic fluid for numerous mechanical systems (e.g., hydraulic lifts, cranes, forklifts, bulldozers, hydraulic jacks, brake systems, combinations thereof, or the like), The high ERBP, WERBP, and low temperature viscosity of these fluid compositions are well-suited for brake systems in transportation vehicles (e.g., fixed and rotary wing aircraft, trains, automobiles in classes 1 to 8, or the like). These braking systems include anti-lock braking systems (ABS), stability control systems, or combinations thereof. Thus, the present invention includes any of these systems which include the fluid compositions disclosed herein.

Traditional automotive brake systems include a depression mechanism operably connected to a master cylinder, a pneumatic or hydraulic booster, brake lines, and a braking mechanism. To operate the brakes, an operator presses the depression mechanism and the master cylinder applies a pressure to the brake fluid that is transmitted through the brake lines to the braking mechanism that at least partially resists the motion of the wheel or wheels. Traditional brake systems require a booster pump to increase the pressure applied to the brake fluid to adequately operate the braking mechanism (e.g., to avoid a collision, when one or more wheels is slipping on a road surface, or combinations thereof) due to the high viscosity of traditional brake fluids.

Brake systems of the present invention may include low viscosity functional fluids described above, traditional higher viscosity brake fluids, or combinations thereof. Preferred brake systems include brake fluids that consist essentially of the low viscosity functional fluids described above. Furthermore, brake systems of the present invention may optionally include a booster pump (e.g. a pre-charge booster pump); however, the booster pump is preferably not included in the brake system as the use of the presently disclosed brake fluid may make the booster pump extraneous. Exclusion of the booster pump would represent a cost savings over systems where a booster pump was required.

It will be further appreciated that functions or structures of a plurality of components or steps may be combined into a single component or step, or the functions or structures of one-step or component may be split among plural steps or components. The present invention contemplates all of these combinations. Unless stated otherwise, dimensions and geometries of the various structures depicted herein are not intended to be restrictive of the invention, and other dimensions or geometries are possible. Plural structural components or steps can be provided by a single integrated structure or step. Alternatively, a single integrated structure or step might be divided into separate plural components or steps. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention. The present invention also encompasses intermediate and end products resulting from the practice of the methods herein. The use of "comprising" or "including" also contemplates embodiments that "consist essentially of" or "consist of" the recited feature.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes.

What is claimed is:

1. A functional fluid composition comprising:

i) an alkoxy glycol component comprising the formula: $RO(CH_2CH_2O)_nH$, wherein R is an alkyl group containing 1 to 8 carbon atoms or mixtures thereof, and n is one or more, wherein the concentration of the alkoxy glycol component having n=2 or more is from about 60 weight percent to about 90 weight percent based on the total weight of the composition;

ii) from about 5 weight percent to about 25 weight percent of a polyglycol lubricant;

iii) an alkoxy gycol borate ester having the formula: $[RO(CH_2CH_2O)_n]_3$—B, wherein R is an alkyl group containing 1 to 8 carbon atoms or mixtures thereof, n is 2 to 4; and iv) about 0.3 weight percent to about 10 weight percent of an additive package including a corrosion inhibitor wherein the composition has a dry equilibrium reflux boiling point of about 205° C. or more, a wet equilibrium reflux boiling point of about 140° C. or more, and a viscosity of about 1500 cSt or less at a temperature of about −40° C.;

the alkoxy glycol component includes an alkoxy glycol having n=2, an alkoxyglycol having n=3, and an alkoxy glycol having n=4 or more; and the concentration of the alkoxy glycol borate ester is less than 4 weight percent.

2. The composition of claim 1, wherein the concentration of the alkoxy glycol having n=2 is from about 0.5 weight percent to about 20 weight percent based on the total weight of the alkoxy glycol component.

3. The composition of claim 2, wherein the concentration of the alkoxy glycol having n=3 is from about 50 weight percent to about 99.5 weight percent, based on the total weight of the alkoxy glycol component.

4. A functional fluid composition comprising:

i) an alkoxy glycol component comprising the formula: $RO(CH_2CH_2O)_nH$, wherein R is an alkyl group containing 1 to 8 carbon atoms or mixtures thereof, and n is one or more, wherein the concentration of the alkoxy glycol component having n=2 or more is from about 60 weight percent to about 90 weight percent based on the total weight of the composition;

ii) from about 5 weight percent to about 25 weight percent of a polyglycol lubricant;

iii) an alkoxy glycol borate ester having the formula: $[RO(CH_2CH_2O)_n]_3$—B, wherein R is an alkyl group containing 1 to 8 carbon atoms or mixtures thereof, n is 2 to 4; and iv) about 0.3 weight percent to about 10 weight percent of an additive package including a corrosion inhibitor wherein the composition has a dry equilibrium reflux boiling point of about 205° C. or more, a wet equilibrium reflux boiling point of about 140° C. or more, and a viscosity of about 1500 cSt or less at a temperature of about −40° C.;

the alkoxy glycol component includes an alkoxy glycol having n=2, an alkoxyglycol having n=3, and an alkoxy glycol having n=4 or more;

the concentration of the alkoxy glycol borate ester is less than about 10 weight percent;

the concentration of the alkoxy glycol having n=3 is from about 55 weight percent to about 85 weight percent, based on the total weight of the alkoxy glycol component and the concentration of the alkoxy glycol having n=2 is from about 1.5 weight percent to about 5 weight percent based on the total weight of the alkoxy glycol component.

5. A functional fluid composition comprising:

i) an alkoxy glycol component comprising the formula: $RO(CH_2CH_2O)_nH$, wherein R is an alkyl group containing 1 to 8 carbon atoms or mixtures thereof, and n is one or more, wherein the concentration of the alkoxy glycol component having n=2 or more is from about 60 weight percent to about 90 weight percent based on the total weight of the composition;

ii) from about 5 weight percent to about 25 weight percent of a polyglycol lubricant;

iii) an alkoxy gycol borate ester having the formula: $[RO(CH_2CH_2O)_n]_3$—B, wherein R is an alkyl group containing 1 to 8 carbon atoms or mixtures thereof, n is 2 to 4; and iv) about 0.3 weight percent to about 10 weight percent of an additive package including a corrosion inhibitor wherein the composition has a dry equilibrium reflux boiling point of about 205° C. or more, a wet equilibrium reflux boiling point of about 140° C. or more, and a viscosity of about 1500 cSt or less at a temperature of about −40° C.;

the alkoxy glycol component includes an alkoxy glycol having n=2, an alkoxyglycol having n=3, and an alkoxy glycol having n=4 or more;

the concentration of the alkoxy glycol borate ester is less than about 10 weight percent;

the concentration of the alkoxy glycol haying n=2 is from about 0.5 weight percent to about 20 weight percent based on the total weight of the alkoxy glycol component;

the concentration of the alkoxy glycol having n=3 is from about 50 weight percent to about 99.5 weight percent, based on the total weight of the alkoxy glycol component; and the alkoxy glycol having n=2 includes butoxy diglycol.

6. The composition of claim 4, wherein the alkoxy glycol having n=2 includes butoxy diglycol, the alkoxy glycol having n=3 includes triethylene glycol monobutyl ether, and the alkoxy glycol having n=4 or more includes methoxy polyglycol.

7. A functional fluid composition comprising:

i) an alkoxy gycol component comprimising the formula: $RO(CH_2CH_2O)_nH$, wherein R is an alkyl group containing 1 to 8 carbon atoms or mixtures thereof, and n is one or more, wherein the concentration of the alkoxy glycol component having n=2 or more is from about 60 weight percent to about 90 weight percent based on the total weight of the composition;

ii) an alkoxy glycol borate ester having the formula: $[RO(CH_2CH_2O)_n]_3$—B, wherein R is an alkyl group containing 1 to 8 carbon atoms or mixtures thereof, n is 2 to 4; and iii) about 0.3 weight percent to about 10 weight percent of an additive package including a corrosion inhibitor;

wherein the alkoxy glycol component includes an alkoxy glycol having n=2, an alkoxyglycol having n=3, and an alkoxy glycol having n=4 or more;

the concentration of the alkoxy glycol borate ester is less than about 10 weight percent based on the total weight of the composition; and the composition has a dry equilibrium reflux boiling point of about 205° C. or more, a wet equilibrium reflux boiling point of about 140° C. or more, and a viscosity of about 1500 cSt or less at a temperature of about −40° C., wherein the concentration of the alkoxy glycol borate ester is less than 4 weight percent.

8. A functional fluid composition comprising:

i) an alkoxy glycol component comprising the formula: $RO(CH_2CH_2O)_nH$, wherein R is an alkyl group containing 1 to 8 carbon atoms or mixtures thereof, and n is one or more, wherein the concentration of the alkoxy glycol component having n=2 or more is from about 60 weight percent to about 90 weight percent based on the total weight of the composition;

ii) an alkoxy glycol borate ester having the formula: $[RO(CH_2CH_2O)_n]_3$—B, wherein R is an alkyl group containing 1 to 8 carbon atoms or mixtures thereof, n is 2 to 4; and iii) about 0.3 weight percent to about 10 weight percent of an additive package including a corrosion inhibitor;

wherein the alkoxy glycol component includes an alkoxy glycol having n=2, an alkoxyglycol having n=3, and an alkoxy glycol having n=4 or more;

the concentration of the alkoxy glycol borate ester is less than about 10 weight percent based on the total weight of the composition; and the composition has a dry equilibrium reflux boiling point of about 205° C. or more, a wet equilibrium reflux boiling point of about 140° C. or more, and a viscosity of about 1500 cSt or less at a temperature of about −40° C., the concentration of the alkoxy glycol having n=2 is from about 0.5 weight percent to about 20 weight percent based on the total weight of the alkoxy glycol component, and the concentration of the alkoxy glycol having n=3 is from about 50 weight percent to about 99.5 weight percent, based on the total weight of the alkoxy glycol component.

9. A functional fluid composition comprising:

i) an alkoxy glycol component comprising the formula: $RO(CH_2CH_2O)_nH$, wherein R is an alkyl group containing 1 to 8 carbon atoms or mixtures thereof, and n is one or more, wherein the concentration of the alkoxy glycol component having n=2 or more is from about 60 weight percent to about 90 weight percent based on the total weight of the composition;

ii) an alkoxy glycol borate ester having the formula: $[RO(CH_2CH_2O)_n]_3$—B, wherein R is an alkyl group containing 1 to 8 carbon atoms or mixtures thereof, n is 2 to 4; and iii) about 0.3 weight percent to about 10 weight percent of an additive package including a corrosion inhibitor;

wherein the alkoxy glycol component includes an alkoxy glycol having n=2, an alkoxyglycol having n=3, and an alkoxy glycol having n=4 or more;

the concentration of the alkoxy glycol borate ester is less than about 10 weight percent based on the total weight of the composition; and the composition has a dry equilibrium reflux boiling point of about 205° C. or more, a wet equilibrium reflux boiling point of about 140° C. or more, and a viscosity of about 1500 cSt or less at a temperature of about −40° C., wherein the concentration of the alkoxy glycol having n=3 is from about 55 weight percent to about 85 weight percent, based on the total weight of the alkoxy glycol component, and the concentration of the alkoxy glycol having n=2 is from about 1.5 weight percent to about 5 weight percent based on the total weight of the alkoxy glycol component.

10. A functional fluid composition comprising:

i) an alkoxy glycol component comprising the formula: $RO(CH_2CH_2O)_NH$, wherein R is an alkyl group containing 1 to 8 carbon atoms or mixtures thereof, and n is one or more, wherein the concentration of the alkoxy glycol component having n=2 or more is from about 60 weight percent to about 90 weight percent based on the total weight of the composition;

ii) an alkoxy glycol borate ester having the formula: $[RO(CH_2CH_2O)_n]_3$—B, wherein R is an alkyl group containing 1 to 8 carbon atoms or mixtures thereof, n is 2 to 4; and iii) about 0.3 weight percent to about 10 weight percent of an additive package including a corrosion inhibitor;

wherein the alkoxy glycol component includes an alkoxy glycol having n=2, an alkoxyglycol having n=3, and an alkoxy glycol having n=4 or more;

the concentration of the alkoxy glycol borate ester is less than about 10 weight percent based on the total weight of the composition; and the composition has a dry equilibrium reflux boiling point of about 205° C. or more, a wet equilibrium reflux boiling point of about 140° C. or more, and a viscosity of about 1500 cSt or less at a temperature of about −40° C., wherein the alkoxy glycol having n=2 includes butoxy diglycol, the alkoxy glycol having n=3 includes triethylene glycol monobutyl ether, and the alkoxy glycol having n=4 or more includes methoxy polyglycol.

11. The composition of claim 1, wherein the composition has a viscosity less than about 1050 cSt at a temperature of about −40° C.

12. The composition of claim 7, wherein the composition has a viscosity less than about 1050 cSt at a temperature of about −40° C.

* * * * *

UNITED STATES PATENT AND TRADEMARK OFFICE

CERTIFICATE OF CORRECTION

PATENT NO. : 7,951,757 B2
APPLICATION NO. : 11/427540
DATED : May 31, 2011
INVENTOR(S) : Gregory A. Carpenter and Pearl L. Crossen It is certified that error appears in the above-identified patent and that said Letters Patent is hereby corrected as shown below:

In the Claims

In Column 8, line 61, Cl. 7, the word "comprimising" should read the word "comprising".

Signed and Sealed this
First Day of September, 2015

Michelle K. Lee

Michelle K. Lee
*Director of the United States Patent and Trademark Office*